US005539623A

United States Patent [19]

Gurz et al.

[11] Patent Number: 5,539,623

[45] Date of Patent: Jul. 23, 1996

[54] LIGHTING DEVICE USED IN AN EXIT SIGN

[75] Inventors: Alan J. Gurz, West Haven; James J. Burns, Deep River, both of Conn.; Hilaro S. Costa, Sarasota, Fla.

[73] Assignee: General Signal Corporation, Stamford, Conn.

[21] Appl. No.: 320,965

[22] Filed: Oct. 12, 1994

[51] Int. Cl.[6] ..... F21V 7/04

[52] U.S. Cl. ..... 362/20; 362/252; 362/800; 362/812; 362/349; 40/570; 40/564

[58] Field of Search ..... 40/564, 570, 573, 40/572, 550, 583, 582, 551; 362/800, 812, 301, 298, 349, 235, 20, 236, 249, 252, 297, 247, 237, 241, 349

[56] References Cited

U.S. PATENT DOCUMENTS

| | | | |
|---|---|---|---|
| 844,087 | 2/1907 | Bellamy . | |
| 859,199 | 7/1907 | Chinnery . | |
| 2,915,844 | 12/1959 | Thomas . | |
| 3,309,806 | 3/1967 | Gallagher . | |
| 3,324,290 | 6/1967 | Lasker . | |
| 3,560,729 | 2/1971 | Liberman . | |
| 3,864,861 | 2/1975 | Hill, Jr. . | |
| 4,139,957 | 2/1979 | Minoque . | |
| 4,211,955 | 7/1980 | Ray . | |
| 4,234,914 | 11/1980 | Boesen . | |
| 4,254,453 | 3/1981 | Mouyard et al. | 362/240 |
| 4,259,800 | 4/1981 | Schoenfeld . | |
| 4,271,408 | 6/1981 | Teshima et al. . | |
| 4,298,869 | 11/1981 | Okuno | 340/782 |
| 4,345,530 | 8/1982 | Mouyard et al. . | |
| 4,383,382 | 5/1983 | Hegarty | 40/545 |
| 4,425,604 | 1/1984 | Imai et al. | 302/223 |
| 4,435,743 | 3/1984 | Plumly | 362/20 |
| 4,443,835 | 4/1984 | Brütigam et al. . | |
| 4,630,183 | 12/1986 | Fujita | 362/311 |
| 4,682,147 | 7/1987 | Bowman | 340/286 |
| 4,720,709 | 1/1988 | Imamura et al. . | |
| 4,724,629 | 2/1988 | Walton | 40/451 |
| 4,727,289 | 2/1988 | Uchida | 315/71 |
| 4,768,300 | 9/1988 | Rutili . | |
| 4,782,429 | 11/1988 | Walton et al. | 362/20 |
| 4,849,864 | 7/1989 | Forrest . | |
| 4,884,178 | 11/1989 | Roberts . | |
| 4,929,866 | 5/1990 | Murata et al. . | |
| 4,951,406 | 8/1990 | Lemire . | |
| 4,965,457 | 10/1990 | Wrobel et al. | 362/249 |

(List continued on next page.)

OTHER PUBLICATIONS

Brochure–Astralite 2000 LED Exit Sign Retrofit Kit Single Sided L.E.D. Retrofit Kit Instructions.

Dual–Lite brochure–We've Created A Masterpiece. Again.

*Primary Examiner*—Denise L. Gromada

*Assistant Examiner*—Thomas M. Sember

*Attorney, Agent, or Firm*—Ware, Fressola, Van Der Sluys & Adolphson

[57] ABSTRACT

A lighting device (32) is provided to illuminate indicia (18) of an EXIT sign (10) having a sign housing (12) defining an enclosure (22) therein and having a primary electrical power source. The lighting device is provided with a reflector (40) having a shallow V-shaped contour (43,44,45) defining a centrally located valley in the reflector and a source of illumination (42) positioned in the valley of the reflector and powered by the primary power source, the source of illumination including two rows of LEDs (65), each row having a plurality of LEDs, and the rows being separated from one another and positioned on either side of the valley. The LEDs are positioned on either side of the valley (44,45) a sufficient distance from the valley to illuminate the edges of the sign parallel to the valley while preventing areas within the valley from having dark and/or unilluminated spots. The rows of LEDs are mounted on opposite edges of a printed circuit board (70) positioned in the valley of the reflector. A side of the printed circuit (72) board facing the indicia to be illuminated is coated with a reflective material. A modular power supply (36) is provided for attachment to a rear side of the reflector (87) above or below a center line (88) perpendicular to the valley. The modular power supply (36) provides a primary source of power (97), and may also include an emergency electrical power supply (107).

27 Claims, 11 Drawing Sheets

U.S. PATENT DOCUMENTS 4,967,317 10/1990 Plumly .
5,012,157 4/1991 Walton et al. ..... 315/66
5,014,167 5/1991 Roberts ..... 362/800 X
5,018,290 5/1991 Kozek et al. ..... 40/570
5,020,252 6/1991 De Boef .
5,036,248 7/1991 McEwan et al. .
5,105,568 4/1992 Branning .
5,136,483 8/1992 Schöniger et al. .
5,160,201 11/1992 Wrobel ..... 362/249
5,186,537 2/1993 Katoh et al. ..... 362/347
5,253,151 10/1993 Mepham ..... 362/241 X
5,268,828 12/1993 Miura .
5,276,591 1/1994 Hegarty .
5,299,109 3/1994 Grondal .
5,303,124 4/1994 Wrobel .
5,365,411 11/1994 Rycroft et al. ..... 362/20
5,416,679 5/1995 Ruskouski et al. ..... 362/800 X
5,448,843 9/1995 Schwartz ..... 312/812 X

LIGHTING DEVICE USED IN AN EXIT SIGN

BACKGROUND OF THE INVENTION

The present invention relates generally to electrical lighting sources and, more particularly, to electrical lighting sources in illuminated EXIT signs.

Under current local fire and building codes, buildings to which the public have access are required to have signage therein identifying the exits. Most of these signs are required to exhibit a specific amount of illumination and, often times, must have an emergency backup power source to provide emergency power to the light for a specific period of time during periods when utility power to the building is discontinued, thereby illuminating the light to facilitate egress of persons from the building.

Traditionally, two 15-watt incandescent lamps driven by 120 volt alternating current (120 VAC) have been employed to provide normal illumination while two 3.6-watt incandescent lamps driven by a self contained emergency battery power supply are used for illumination during power failure situations. A switching or transfer device will automatically operate the emergency backup illumination system when a power failure is detected.

While these traditional EXIT sign lighting arrangements perform adequately, they do have a few drawbacks. A major drawback is that the incandescent bulbs use large amounts of electric power thus requiring high operating costs and a relatively large emergency battery power supply for use during emergency lighting situations. Furthermore, while the incandescent bulbs provide adequate illumination, such bulbs do not have a long life in service and require frequent replacement.

To alleviate the drawbacks associated with incandescent bulbs, many manufacturers are beginning to utilize light emitting diodes (LEDs) rather than incandescent bulbs in EXIT signs. Each LED provides a relatively small amount of light as compared to traditional incandescent bulbs whereby a large number of LEDs must be used to provide the same amount of illumination offered by the traditional incandescent bulbs.

It is an object of the present invention to provide a novel lighting device for an EXIT sign using a plurality of LEDs.

It is also an object to provide such a lighting device which allows the LEDs to be powered by both a normal utility electrical power supply (120 VAC) and, during emergency power situations, an emergency battery power supply and associated charging and transfer circuitry.

Still another object is to provide such a lighting device in which the LEDs are arranged in the EXIT sign to provide the amount of illumination required by building codes.

A further object is to provide such a lighting device which may be readily and economically fabricated and would enjoy a long life in operation.

A still further object of the present invention is to provide such a lighting device which may be easily retrofit into the housing of an existing EXIT sign utilizing incandescent bulbs.

Another object is to provide such a lighting device which may be arranged back to back with other such lighting devices to provide a source of light on two sides, such devices being retrofit into an existing housing of an EXIT sign.

SUMMARY OF THE INVENTION

According to the present invention, a lighting device is provided to illuminate indicia of an EXIT sign having a sign housing defining an enclosure therein and having a primary electrical power source. The lighting device is provided with a reflector having a shallow V-shaped contour defining a centrally located valley in the reflector and a source of illumination positioned in the valley of the reflector and powered by the primary power source, the source of illumination including two rows of LEDs, each row having a plurality of LEDs, and the rows being separated from one another and positioned on either side of the valley.

In further accord with the present invention, the V-shaped contour is vertically oriented in the enclosure, and the rows of LEDs are positioned on either side of the V-shaped contour, the LEDs being positioned adjacent to the reflector to maximize the distance between the LEDs and the indicia to be illuminated. The LEDs are also positioned on either side of the valley a sufficient distance from the valley to illuminate the edges of the sign parallel to the valley while preventing areas within the valley from having dark and/or unilluminated spots. The rows of LEDs are mounted on either side of a printed circuit board positioned in the valley of the reflector. A side of the printed circuit board facing the indicia to be illuminated may be coated with a reflective material to further enhance the distribution of light within the housing. Alternatively, the printed circuit board may be translucent or transparent to improve light distribution and transmission within the housing. The printed circuit board is electrically connected to, and has electrical components for, the plurality of LEDs.

In still further accord with the present invention, internal baffles may be positioned on the reflector at or near the edges of the reflector parallel to the valley, the baffles also being positioned at the edges of the indicia to be illuminated to minimize the area required to be illuminated by the light sources. For special worded signs and retrofit applications, the internal baffles may be repositioned or omitted completely.

According further to the present invention, a modular power supply is provided for attachment to a rear side of the reflector, the modular power supply being positioned above or below a center line perpendicular to the valley. The modular power supply includes rectifier means attached to a utility power source for rectifying the source of power prior to being provided to the LEDs. Desirably, the modular power supply also includes an emergency electrical power supply to provide auxiliary power to the LEDs in the event of failure of the primary electrical power supply. The emergency electrical power supply is at least one rechargeable battery and includes a charging device for keeping the at least one rechargeable battery fully charged during periods of nonuse. The emergency electrical power supply is mounted within the modular power supply and is optionally connected to the primary electrical power supply to detect failure of the primary electrical power supply and thereafter provide auxiliary power to the LEDs.

According still further to the present invention, a pair of modular power supplies may be positioned between a pair of lighting devices to provide illumination within a housing having indicia on two sides of the housing. Alternatively, a single modular power supply mounted between a pair of lighting devices may be provided for illuminating a housing having indicia on two sides, the single modular power supply covering the entire rear side of the lighting device reflector.

The foregoing and other objects, features and advantages of the present invention will become more apparent in light of the following detailed description of exemplary embodiments thereof, as illustrated in the accompanying drawings.

BRIEF DESCRIPTION OF THE DRAWINGS

FIG. 10 is a top view showing two lighting devices having power supply modules located there between;

DETAILED DESCRIPTION OF THE INVENTION

The lighting device of the present invention is particularly well suited for retrofit mounting within a housing of an existing EXIT sign. A power supply module may be provided for use with the lighting device to provide both a direct or primary source of power and an emergency backup source of power. The lighting device of the invention may be provided as a single unit within an EXIT sign housing having indicia to be illuminated on one side, or a pair of lighting devices of the present invention may be provided arranged back-to-back for illuminating two sides of an EXIT sign housing.

Figure 1:
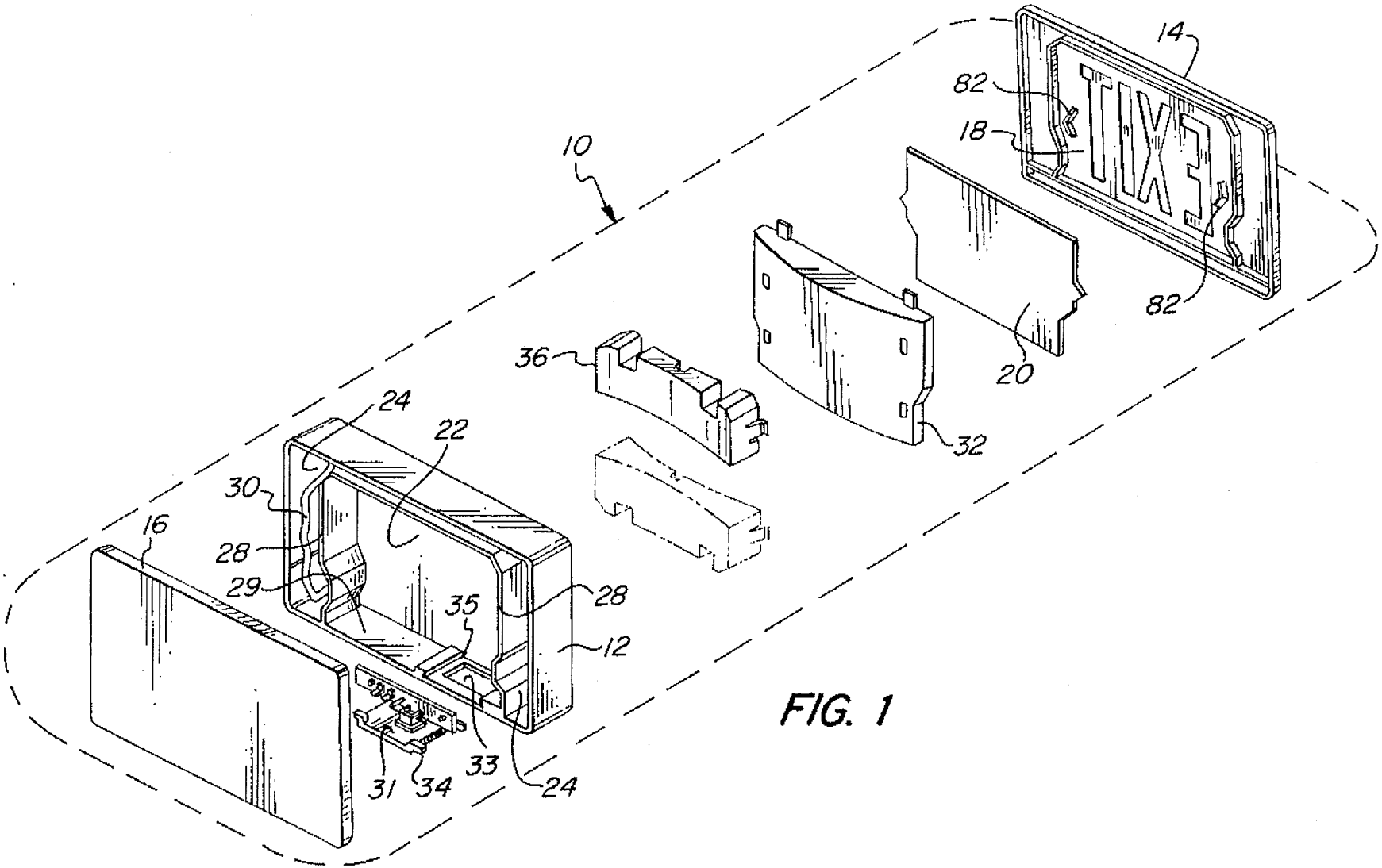
FIG. 1 is an exploded perspective view of a lighting device of the present invention in relation to an EXIT sign housing.

Referring to FIG. 1, an EXIT sign 10 is mountable both on a canopy bracket (not shown) and a standard electrical junction box (not shown) in a manner explained in co-pending U.S. patent application Ser. No. 07/925,133, entitled CANOPY MOUNTING DEVICE FOR EXIT SIGNS AND THE LIKE. With this arrangement, the EXIT sign construction of this invention can be mounted directly to a standard electrical junction box found in a ceiling or wall of a building in any desired location.

The EXIT sign 10 comprises a central rectangular shaped frame 12 with front and back cover members 14, 16, at least one of which incorporates a large stencil 18 having the letters "EXIT" in the major surface thereof and a colored diffuser 20 therebehind. The diffuser may be made of a transparent material which is colored or screened to a desired color. Although the invention is described herein as being used with a sign having the letters "EXIT" in a large stencil, it will be understood by those skilled in the art that the principles of the invention disclosed herein are also applicable to signs having other letters in a stencil.

The central rectangular shaped frame 12 and the front and back cover members 14, 16 are snapped-fit together and cooperate to form a housing 10 having an enclosure 22 containing the necessary internal electrical lighting components. The front and back covers 14, 16 can use a plurality of finger clips (not shown) to hold them in assembly with the central rectangular shaped frame 12. The EXIT sign 10 is preferably molded from a plastic resin such as an engineering type thermoplastic, e.g., ABS, polycarbonate or polystyrene oxide, but it should be apparent to those skilled in the art that it may be manufactured from other suitable materials.

Within the enclosure 22 of the EXIT sign 10, a wiring compartment 24 is formed by a retaining wall 28 which extends around the interior sides and top of the central rectangular shaped frame 12. The retaining wall 28 is mounted on its ends to a bottom side 29 of the rectangular shaped frame 12. In a manner explained further hereinafter, the wiring compartment 24 contains an appropriate wiring harness 30 or other suitable signal transmission media for providing utility power to a primary power source for the lighting device of the present invention.

An emergency power supply test and indication device 31, which is described in greater detail hereinafter, may be provided for mounting in an aperture 33 formed in the bottom side 29 of the rectangular shaped frame 12. The indication device 31 is provided with tabs 34 for interlocking and sliding engagement with corresponding channels 35 formed in the bottom side 29 of the rectangular shaped frame 12 on opposite sides of the aperture 33.

The lighting device 32 of the present invention is intended for either retrofit application in the enclosure 22 of an existing EXIT sign 10 and also for application in a new EXIT sign. The lighting device 32 is positioned within the enclosure 22 behind the diffuser 20 so that light provided by the lighting device 32 may be projected through the diffuser and the front cover stencil 18 for lighting the stencil letters. The lighting device 32 is provided with at least one power supply module 36, the power supply module 36 being configured for attachment on a rear side of the lighting device 32 above or below a horizontal center line. As will be described in greater detail hereinafter, the power supply module 36 is used to provide a primary power source to a light array of the lighting device 32 and also may comprise a backup power supply and additional circuitry as desired for providing enhanced features with the EXIT sign 10.

Figure 2:
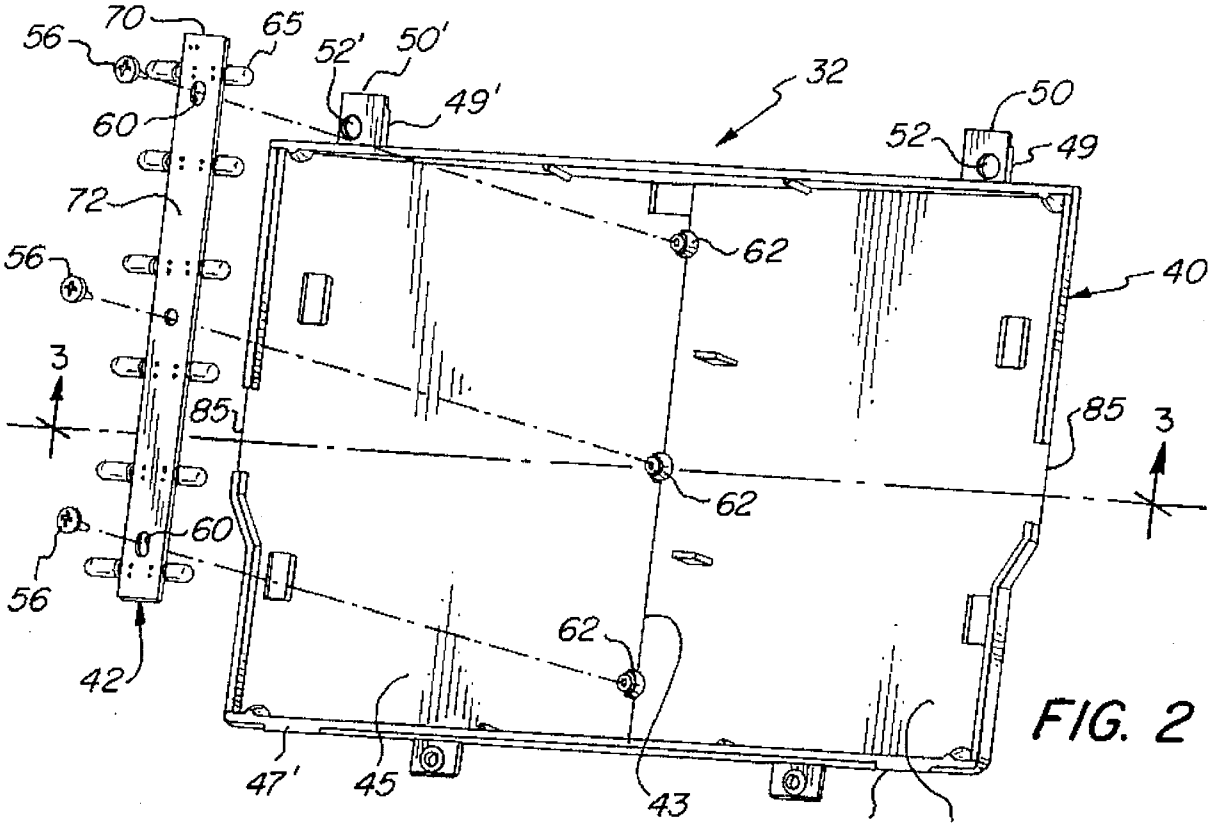
FIG. 2 is an exploded perspective view of an LED array having red LEDs and a reflector of the lighting device of FIG. 1.
Figure 3:
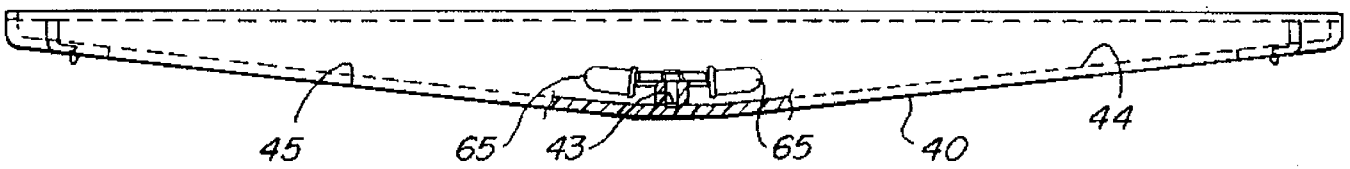
FIG. 3 is a cross-sectional view of the reflector and LED array taken along line 3—3 of FIG. 2 and illustrating the height relationship between the LED array and the reflector.

Referring now to FIGS. 1, 2 and 3, the lighting device 32 comprises a reflector 40 and a light array 42. The reflector 40 is generally concave or V-shaped having a central vertically oriented valley 43 with reflective surfaces 44,45 extending outwardly therefrom. The concave or V-shaped design of the reflector is shown in greater detail in FIG. 3. A pair of snap-fit tabs 47, 47' are provided on a bottom side of the reflector 40 and a pair of mounting tabs 49, 49' are provided on the top side of the reflector 40. The mounting tabs 49, 49' have tab ends 50, 50' and apertures 52, 52' formed therein so that the mounting tabs 49 may either provide snap-fit mounting or mounting using other fastening means such as threaded fasteners (not shown). The mounting tabs 49, 49' and snap fit tabs 47, 47' cooperate to hold the lighting device to either one of the EXIT sign cover members 14, 16 having the stencil 18.

The lighting array 42 is mounted in the valley 43 of the reflector 32 by means of threaded fasteners 56 which are received through apertures 60 in the array and are fastened to internally threaded posts 62 located in the valley 43 of the reflector 32. The lighting array 42 comprises two rows of LEDs 65, each row being positioned on either side of the valley 43. As shown in FIG. 3, once the array 42 is mounted in the valley 43, the rows of LEDs 65 are positioned immediately adjacent to the reflector surfaces 44,45.

It has been found that for optimal illumination of the stencil 18, the rows of LEDs 65 should be positioned as far away from the diffuser 20 and stencil 18 as possible within the reflector valley 43, and also, the LEDs 65 should be offset from the reflector center-line or valley 43 a sufficient amount so that the light from the LEDs 65 reaches the edges of the reflector 40 to illuminate the entire stencil 18. It has also been found that depending on the power output, e.g., the amount of illumination, provided by the LEDs 65 used in the lighting array 42, various array configurations may be required. For example, the array 42 illustrated in FIG. 2 comprises twelve LEDs 65 making up two rows with six LEDs 65 in each row. The two rows are evenly spaced apart on either side of the valley 43. This configuration is particularly useful for higher intensity LED light sources such as red LEDs. The LEDs 65 are mounted on a circuit board 70 and provided power from the power supply module 36 as described hereinafter. A side of the circuit board 72 facing the diffuser 20 and stencil 18 may be coated with a reflective material, such as a white solder mask, to further enhance the reflection of light within the reflector 40, and through the diffuser 20 and stencil 18.

Figure 4:
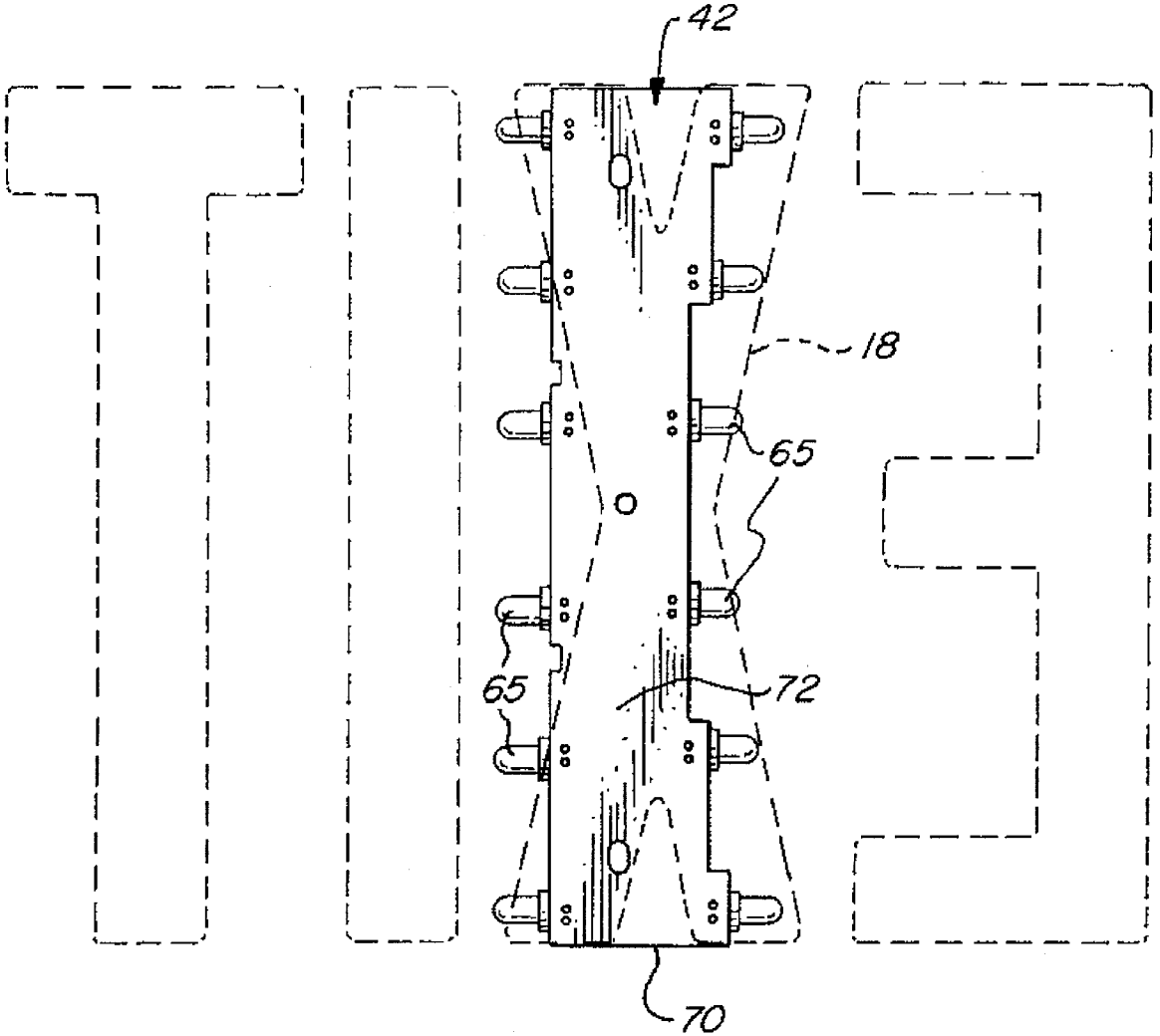
FIG. 4 is a top view of an alternative LED array having amber LEDs for use with the lighting device of FIG. 1.

For lower intensity LEDs, such as green LEDs, a different array configuration and/or additional LEDs may be required to provide a sufficient amount of illumination for the stencil 18. Additionally, various array configurations may be used to improve the overall visual appearance of the stencil. Referring now to FIG. 4, an example of an array 42 using amber LEDs 65 is shown. In this case, the array comprises twelve LEDs 65 making up two rows of six LEDs 65 each. However, the rows are further offset from each other than the rows of red LEDs (FIG. 2), and additionally, one row of LEDs is staggered to provide the proper illumination within the reflector. Although amber LEDs typically do not have the same intensity level as the red LEDs, there is sufficient intensity provided by twelve amber LEDs to provide the required amount of illumination through the stencil 18 provided that the rows of LEDs are offset from one another and one row of LEDs is staggered. As is seen in FIG. 4, one row of LEDs generally follows the outline of the letter I in the word EXIT, and the other row of LEDs generally follows the outline of one-half of the letter X in the word EXIT. Using this arrangement, in conjunction with a reflective surface 72 provided on the circuit board 70, provides a sufficient amount of illumination to illuminate the letters in a stencil containing the-word EXIT.

Figure 5:
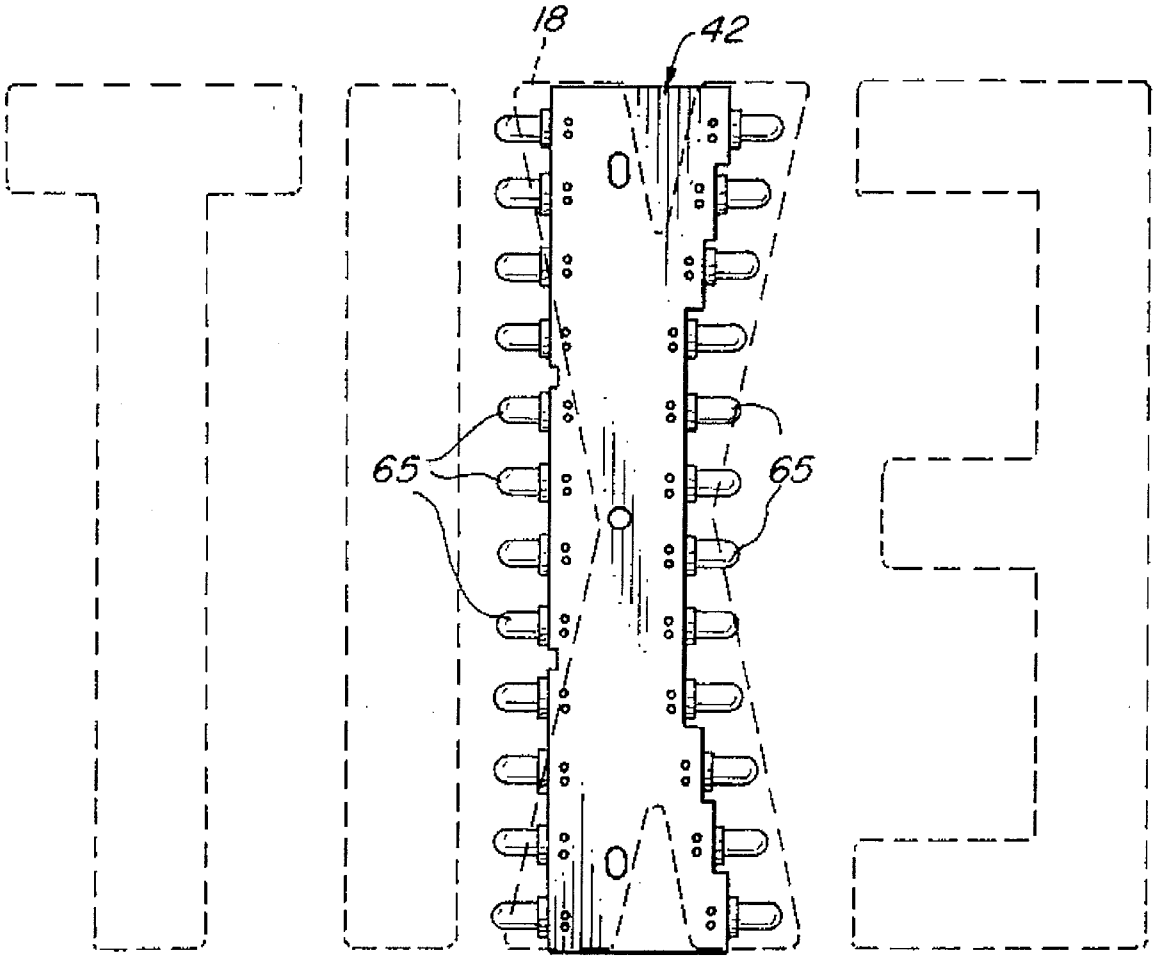
FIG. 5 is a top view of a second alternative LED array having green LEDs for use with the lighting device of FIG. 1.

Referring now to FIG. 5, a second alternative LED array 42 is illustrated. In the FIG. 5 embodiment, twenty-four LEDs 65 are provided in two rows of twelve LEDs 65. As with the FIG. 4 embodiment, the rows of LEDs are further offset from each other than the rows of higher intensity red LEDs, and one row of LEDs is staggered to generally follow the outline of the letter X in the word EXIT. This arrangement is useful for a low intensity light source such as a green LED. It has been found that this arrangement provides sufficient illumination through the letters of the word EXIT in a stencil 18.

Figure 6:
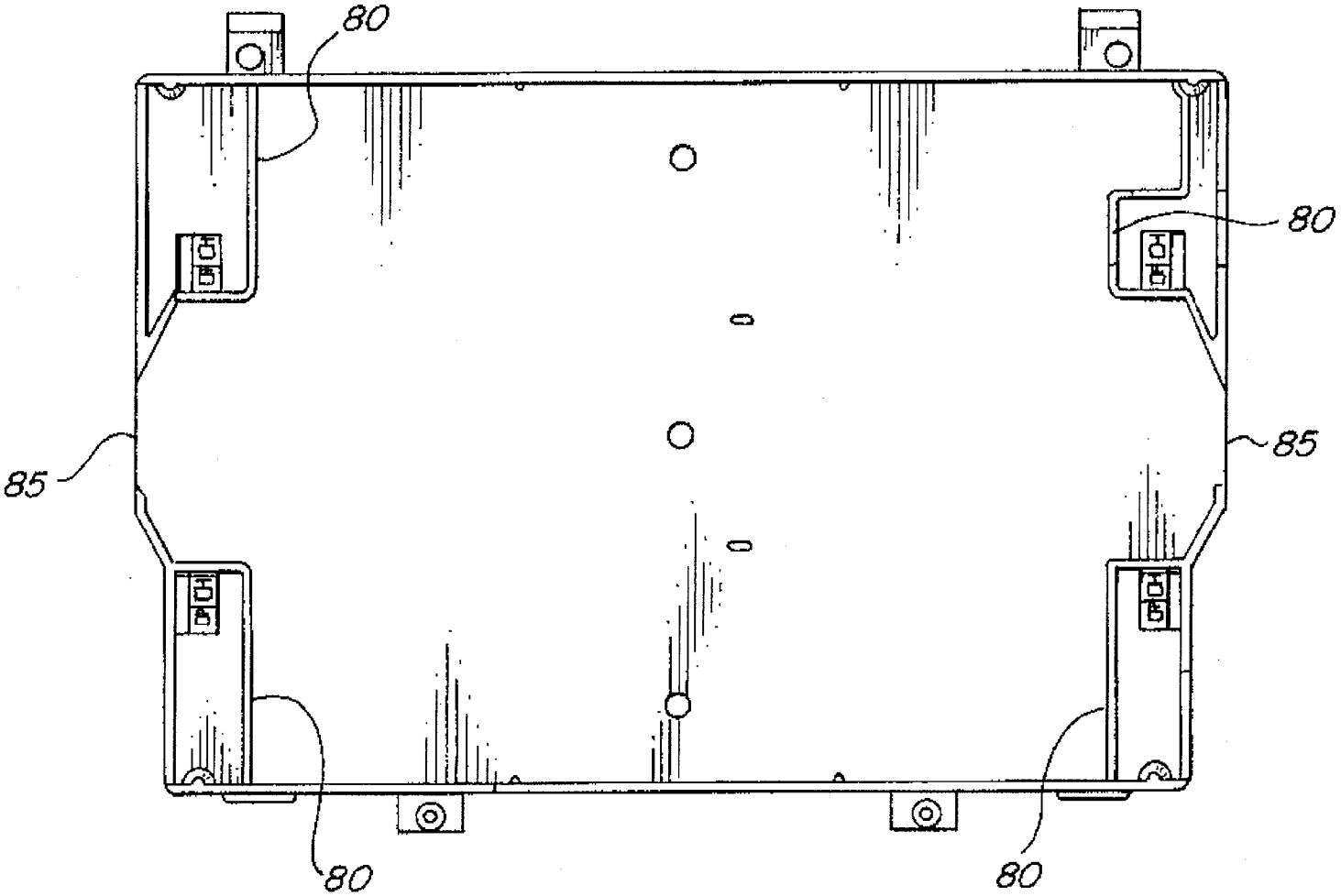
FIG. 6 is a top view of an alternative reflector for use with the lighting device of FIG. 1 showing baffles located within the reflector.

Referring now to FIGS. 2 and 6, in conjunction with the LED arrays illustrated in FIGS. 4 and 5, baffles 80 are positioned within the reflector 40 to limit the area within the reflector 40 required to be illuminated by the LED array 42 when lower intensity LEDs are used. However, these baffles 80 may also be used with the higher intensity LEDs if desired. Referring also to FIG. 1, Chevrons 82 may be provided on either side of the word EXIT in the stencil 18, and therefore, the baffles 80 are arranged so that light from the array 42 may reach the Chevrons 82. Additionally, cut outs 85 are provided in either end of the reflector 40 in the location of the tip of Chevrons 82 so that light may reach the tip of the Chevrons 82.

It will therefore be understood by those skilled in the art that when an array 42 is placed in the valley 43 of the reflector 32, and the array 42 is energized, light from the rows of LEDs 65 in the army 42 will project onto the reflecting surfaces 44,45 and be directed outwardly through the diffuser 20 and stencil 18. If lower intensity bulbs are used, then either the arrangement of FIG. 4 or FIG. 5 may be used to ensure that sufficient light is provided throughout the whole reflector area. Additionally, baffles 80 may be provided within the reflector 40 when lower intensity light arrays 42 are used to minimize the area required to be illuminated by the LED array. In either case, the baffles 80 are arranged such that the light may reach a Chevron 82 placed on either or both sides of the word EXIT, and the ends of the reflector 40 in the area of the Chevron 82 have cut outs 85 such that light may reach the tip of each Chevron 82. Each of the circuit boards 70 which carry the rows of LEDs 65 may be coated with a reflective material on a side 72 facing the diffuser 20 and stencil 18 such that light reflected within the reflector 40 will reflect off the side 72 of the circuit board and be reflected out through the stencil 18. This will prevent the formation of local areas of low intensity light which would show up as dim or unlit spots on the EXIT sign.

Depending on the color of LEDs used in the array 42, various diffusers 20 may be used to provide the proper coloration of the letters in the stencil 18. For example, if red LEDs are used, then a clear polycarbonate diffuser panel with a red day glow coloration silk screened on one side may be provided. Alternatively, other materials may be utilized for the diffuser 20. For example, if either green or amber LEDs are used, a sheet of milk white translucent styrene may be used as the diffuser 20. In the case of green LEDs, the sheet of styrene may be coated on one side with a day glow green coloration.

Figure 7:
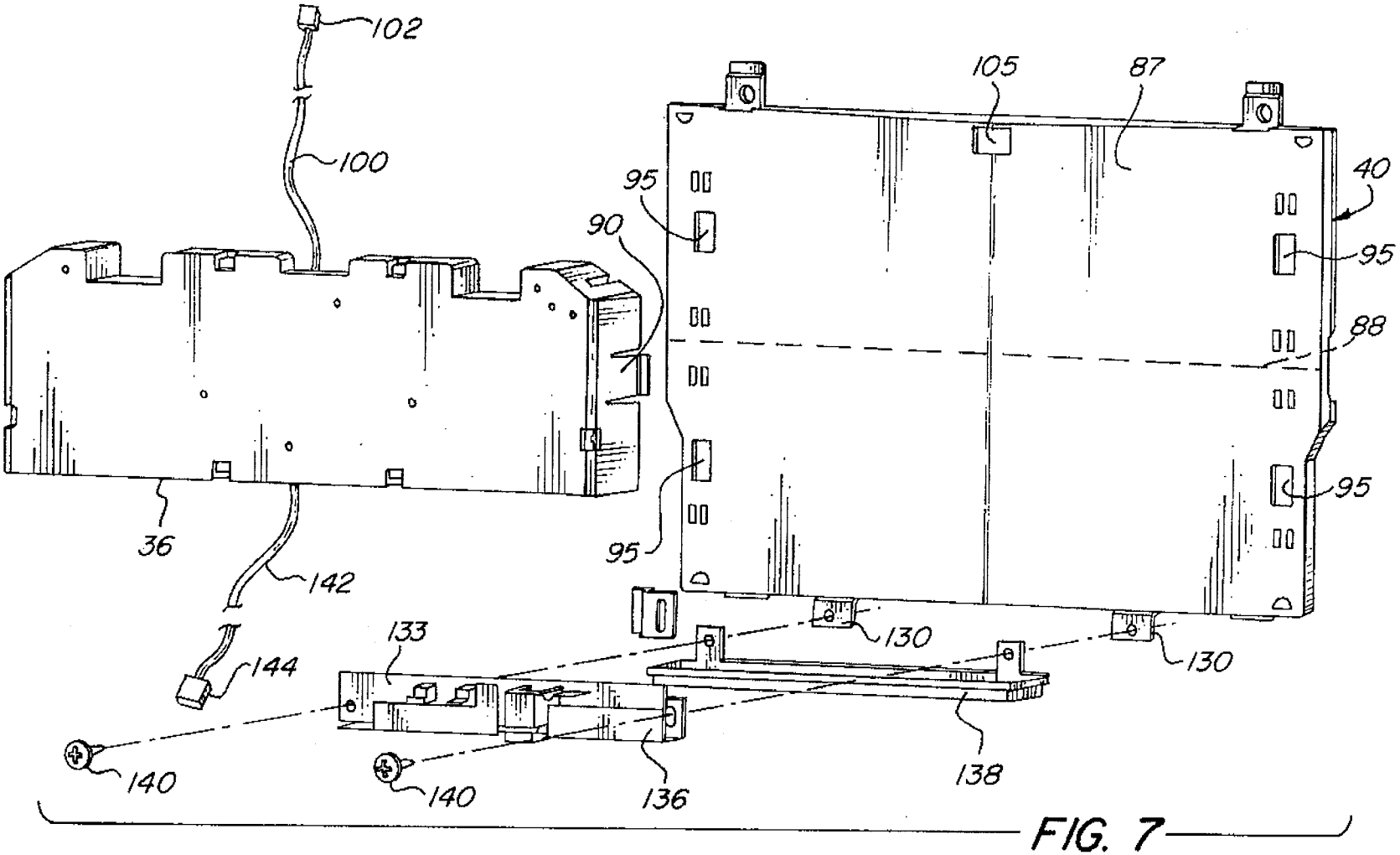
FIG. 7 is an exploded perspective view of the reflector and power supply module showing a power supply test circuit and bracket in relation to the reflector.

Referring now to FIG. 7, a power supply module 36 may be mounted on a rear side 87 of the reflector 40, above or below a horizontal center line 88 of the reflector 40 which is perpendicular to the reflector valley 43 (FIG. 2). Resiliently deformable retaining members 90 are attached on sides of the power supply module 36 for mating engagement with apertures 95 formed in the reflector 40. Four apertures 95 may be provided in the rear side 87 of the reflector 40 so that the power supply module 36 may be either mounted above or below the horizontal center line 88 of the reflector 40.

Figure 8:
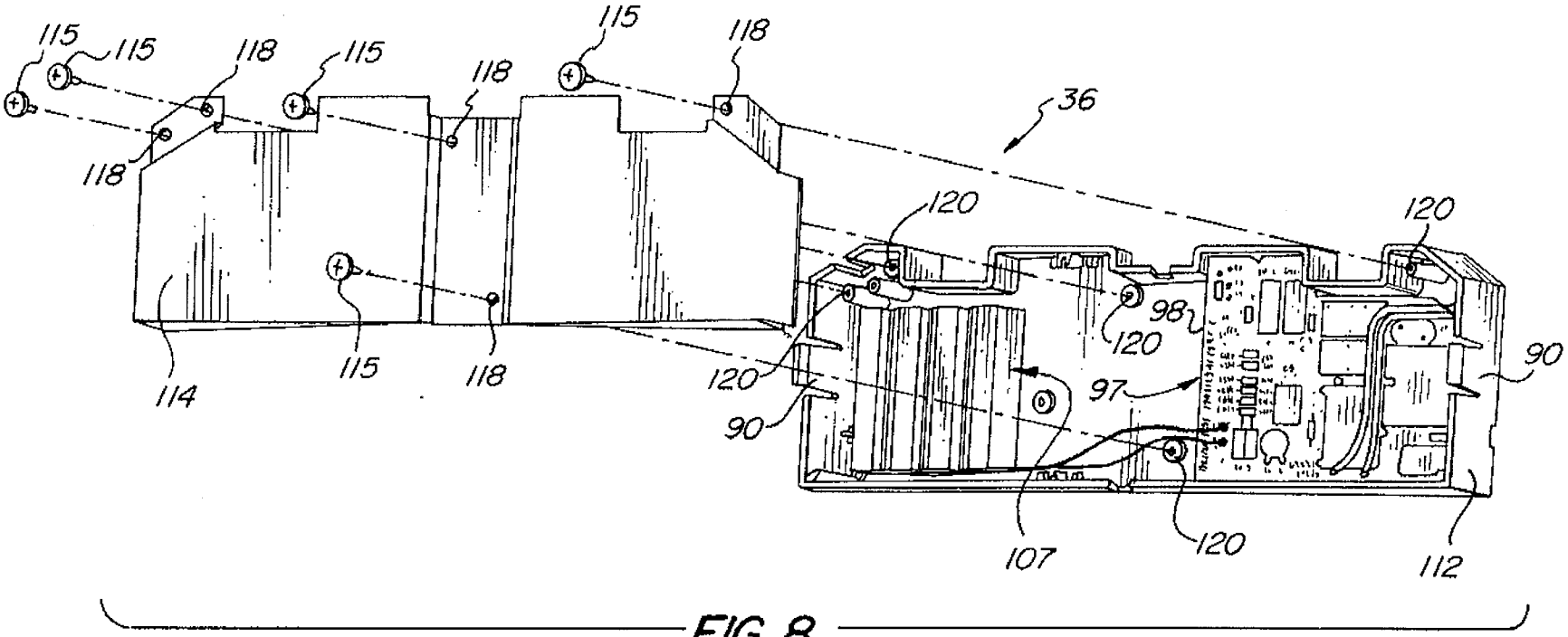
FIG. 8 is an exploded perspective view of a power supply module for use with the lighting device of FIG. 1.

Referring also to FIG. 8, the power supply module is provided with electronic circuitry 97 which is mounted on a circuit board 98 and positioned within the power supply module 36 for providing a primary power source to the array. The electronic circuitry 97 may be provided with utility power from a utility 120 volt AC power supply via the wiring harness 30 (FIG. 1) from electrical leads (not shown) which extend into an electrical junction box (not shown) found in the ceiling or wall of a building. The electronic circuitry 97 comprises means for rectifying the 120 volt AC power into a DC power supply in a way which is well known in the art. The DC power may be used to power the LEDs in the array. The DC power is provided on a line 100 which may terminate in a connector 102, the line 100 and connector 102 may be passed through an aperture 105 formed in the rear surface 87 of the reflector, and the connector 102 may be attached to a terminal (not shown) on the circuit board 70 (FIG. 2) of the array for powering the LEDs 65 (FIG. 2) in the array 42 (FIG. 2).

The power supply module 36 may also be provided with an emergency backup power source 107, e.g., at least one battery, to provide power to light the LEDs in case the primary power source is not available. In this case, the circuitry 97 is also be provided with transfer circuitry for automatically powering the LED array from the emergency power supply 107 in the event that the primary power source is not available. Additionally, the circuitry 97 may be provided with battery charging circuitry to maintain the charge on the battery 107 when it is not in use. The transfer circuitry and battery charging circuitry may be of a type know in the art. Alternatively, an example of transfer circuitry and battery charging circuitry of the type which may be used with the present invention is given in commonly owned, co-pending U.S. patent application Ser. No. 08/160,583 entitled LIGHTING DEVICE USED IN AN EXIT SIGN.

Referring to FIG. 8, the power supply module 36 is provided in two pieces including a housing 112 and a removable cover 114 which is mounted to the housing 112 with threaded fasteners 115. The threaded fasteners 115 are received through apertures 118 formed in the removable cover 114 and are engaged with internally threaded mounting posts 120 molded with the housing 112. As with the EXIT sign 10, the power supply module 36 is preferably molded from a plastic resin such as an engineering type thermoplastic, e.g., ABS, polycarbonate or polystyrene oxide, but it should be apparent to those skilled in the art that it may be manufactured from other suitable materials.

Referring again to FIG. 7, an emergency power supply test and indication device 31 of a type known in the art may be mounted on tabs 130 attached to the bottom of the reflector 40. The indicator 31 includes a printed circuit board 133 having test circuitry mounted thereon which is surrounded by a piece of insulating material 136 and attached to the tabs 130 via a mounting bracket 138 using threaded fasteners 140. A wiring harness 142 having a connector 144 for engagement with a terminal (not shown) on the circuit board 133 may be provided to connect the modular power supply circuitry 97 to the test assembly 31.

Figure 9:
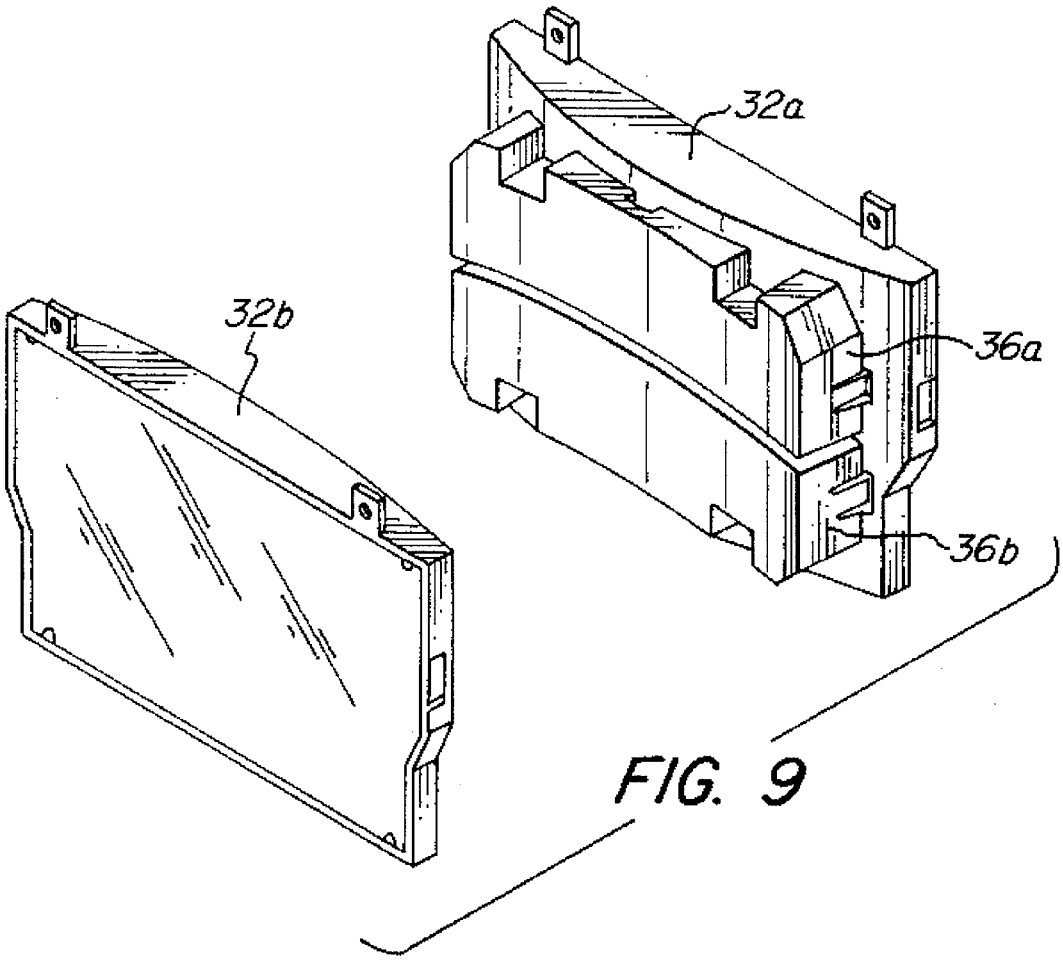
FIG. 9 is a perspective view showing two lighting devices, each lighting device having a power pack mounted on a rear surface of the reflector for back-to-back arrangement of the lighting devices.
Figure 10:
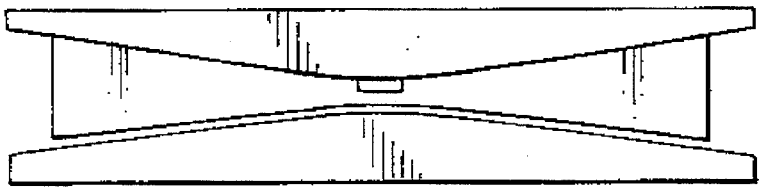
Figure 11:
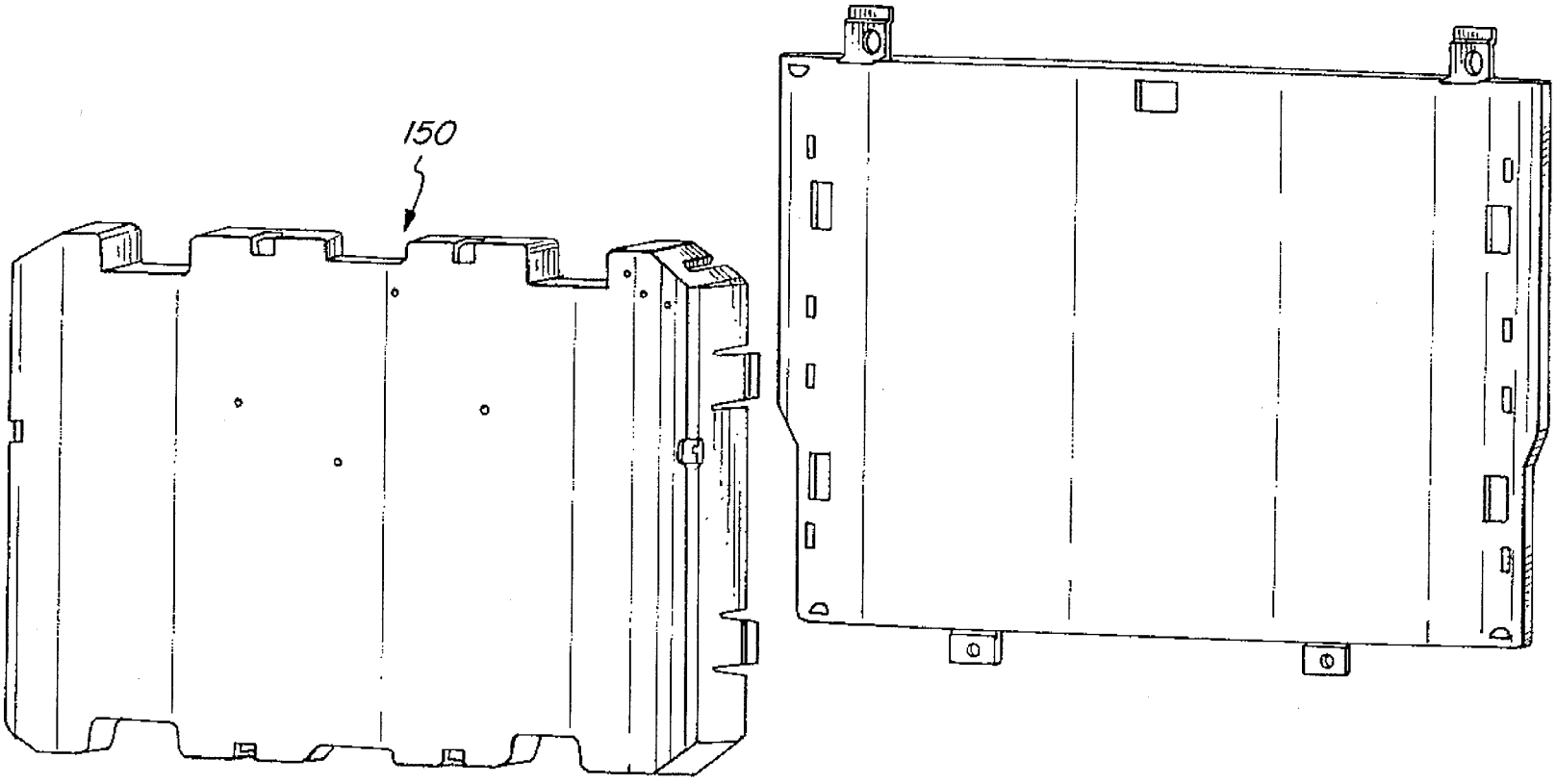
FIG. 11 is a perspective view showing a power supply module which covers the entire rear surface of a reflector.

Referring now to FIGS. 9 and 10, a pair of lighting devices **32*a*, 32*b* are shown, each having a power supply module, 36*a* and 36*b* mounted above and below the horizontal center line 88 (FIG. 7), respectively. The lighting devices 32*a*, 32*b* and power supply modules 36*a*, 36*b* may be arranged back-to-back, as shown, to provide a two sided lighting source for an EXIT sign 10 which has two sides. Alternatively, a single lighting device 32*a* and power supply module 36*a* may be provided as a single unit in a one sided EXIT sign as previously described herein. Alternatively, referring to FIG. 11, when it is intended that two lighting devices be arranged back-to-back as illustrated in FIG. 10, a single power supply module 150 may be provided which covers the entire rear surface of one of the lighting devices for providing primary and emergency power to two lighting devices. Alternatively, the single power supply module 150** may be provided with one lighting device when additional test and monitoring equipment is provided with the EXIT sign.

Figure 12:
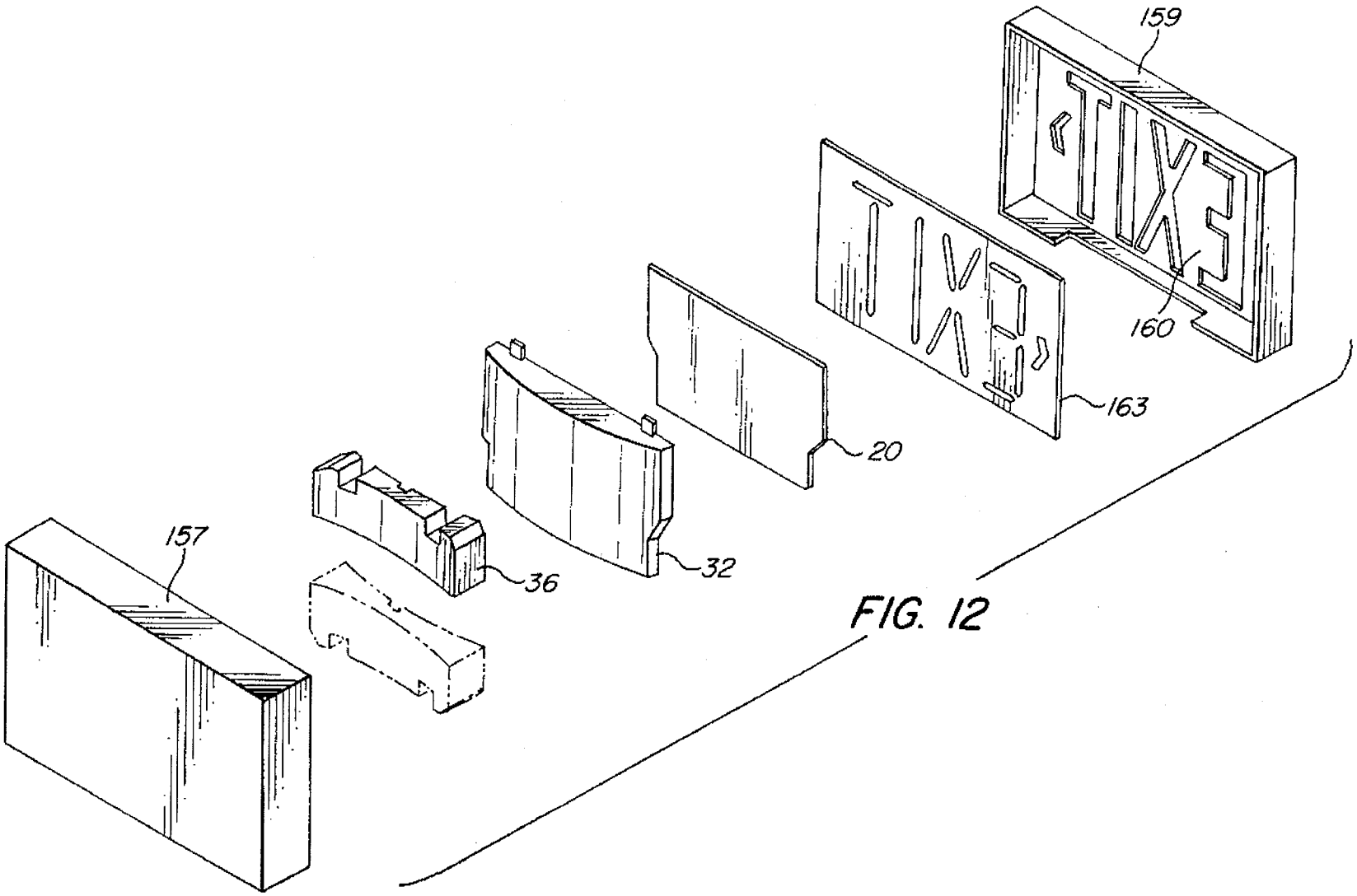
FIG. 12 is an exploded perspective view of an alternative housing for use with the lighting device of the present invention.

Although the invention was described herein for retrofit application in an EXIT sign 10 molded from a thermoplastic, the invention is also applicable to an EXIT sign having a die cast housing and a die cast front panel as is known in the art. For example, referring to FIG. 12, an EXIT sign having a die cast housing 157 and a die cast front cover 159 is shown. The front cover has the letters "EXIT" cut out in the major surface 160 thereof, and a stencil panel 163 is provided having the letters "EXIT" therein to provide a more refined appearance. As with the thermoplastic housing, a lighting device 32 and at least one power supply module 36 are positioned within the housing 157 behind a diffuser 20, the lighting device 32 illuminating the letters in the stencil panel 163 through the diffuser.

Figure 13:
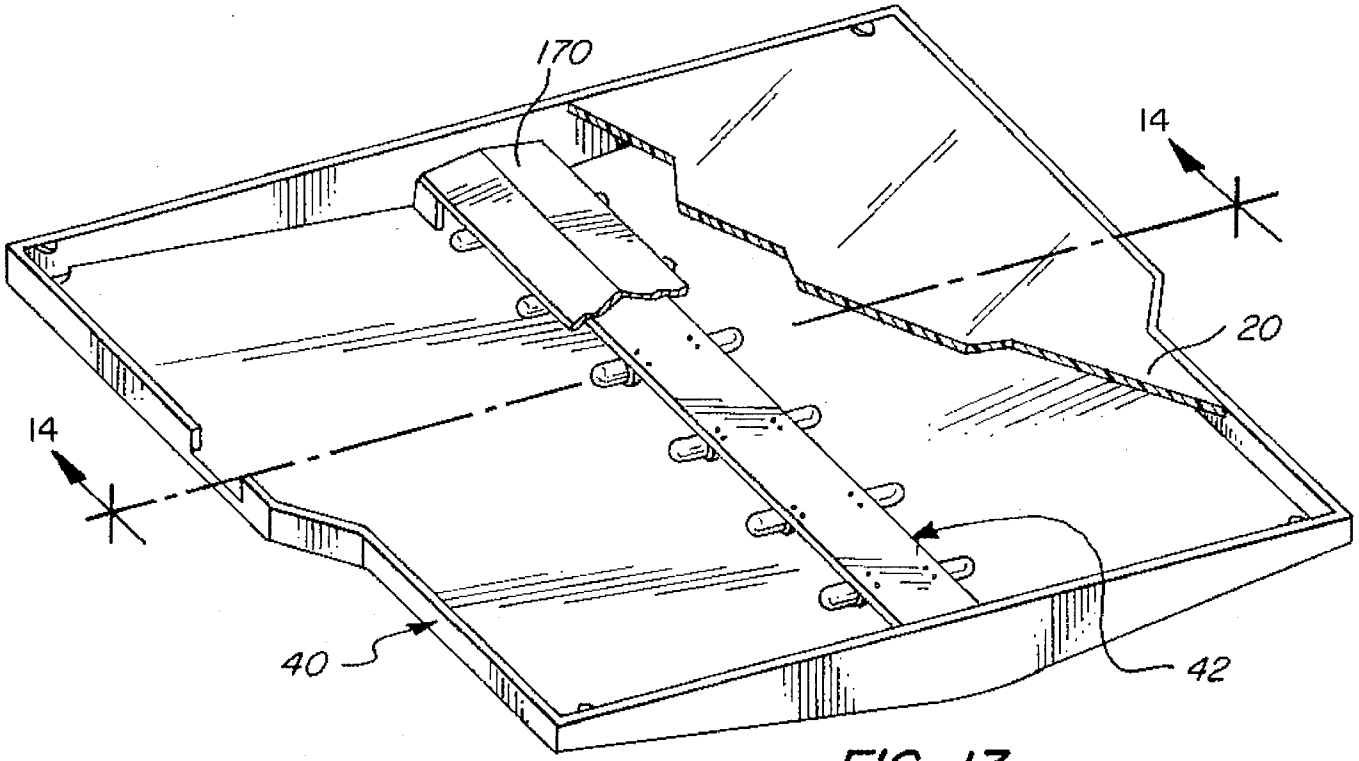
FIG. 13 is a perspective view, partially broken away, of the lighting device of FIG. 1 having a baffle placed in front of the LED array.
Figure 14:
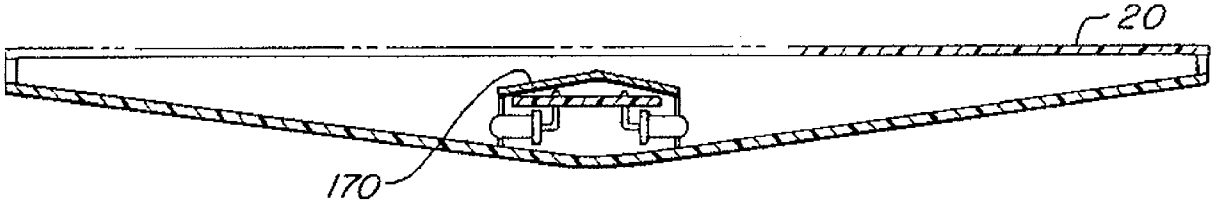
FIG. 14 is a cross-sectional view taken along line 14—14 of FIG. 13.

Although the invention has been illustrated with the light array 42 positioned between the reflector 40 and the diffuser 20, the array being positioned immediately adjacent to the reflection panel, a diffuser deflector 170 may be provided between the light array 42 and diffuser 20 if desired, as shown in FIGS. 13 and 14. Referring to FIGS. 13 and 14, the diffuser deflector 170 may be particularly useful with an array having high intensity LEDs to prevent hot spots (bright spots) in local areas of a stencil corresponding to the location of LEDs behind the stencil. The diffuser deflector 170 may be made of either an opaque or translucent material.

The invention has been described herein using either 12 or 24 LEDs in an LED array 42. However, it will be understood by those skilled in the art that various combinations of LEDs may be used to provide the desired lighting effect. Considerations used to determine the proper number of LEDs to use in an array include: the size of the area to be illuminated; the light intensity produced by the LEDs; the light beam pattern of the LEDs; the size of the stencil opening; the specific diffuser material used; etc.

Although the invention has been described and illustrated with respect to exemplary embodiments thereof, it should be understood by those skilled in the art that the foregoing and various other additions and omissions may be made therein and thereto without departing from the spirit and scope of the present invention.

What is claimed is:

1. A lighting device for illuminating indicia of an EXIT sign having a sign housing defining an enclosure therein and having indicia to be illuminated and having a primary electrical power source, comprising:

a reflector having a shallow V-shaped contour defining a centrally located valley therein;

said reflector including a first reflective surface on a first side of said valley and a second reflective surface on a second side of said valley; and illumination means positioned in said valley of said reflector to be powered by the primary electrical power source, said illumination means including two rows of light emitting diodes, each row having a plurality of light emitting diodes, said rows being separated from one another and positioned on either side of said valley for illuminating said reflector V-shaped contour including said valley.

2. A lighting device according to claim 1, wherein said V-shaped contour is vertically oriented in said reflector, and wherein said rows of light emitting diodes are positioned on either side of said V-shaped contour.

3. A lighting device according to claim 2, wherein said rows of light emitting diodes are positioned a sufficient distance from said V-shaped contour to provide illumination to the sides of the EXIT sign housing parallel to said V-shaped contour.

4. A lighting device according to claim 1, wherein each of said light emitting diodes are positioned adjacent to said reflector and at a distance from the indicia to be illuminated.

5. A lighting device according to claim 1, further comprising baffle means mounted to said reflector for minimizing the area within said reflector required to be illuminated by said rows of light emitting diodes.

6. A lighting device according to claim 1, wherein said rows of light emitting diodes are mounted on opposite edges of a printed circuit board, said printed circuit board being mounted in said V-shaped contour.

7. A lighting device according to claim 6, wherein said printed circuit board is part of said illumination means.

8. A lighting device according to claim 6, wherein a side of said printed circuit board facing the indicia to be illuminated is coated with a reflective material.

9. A lighting device according to claim 8, wherein said reflective material is at least one layer of white solder mask.

10. A lighting device according to claim 6, wherein said printed circuit board has electrical components thereon for said illumination means.

11. A lighting device according to claim 1, further comprising a power supply module for providing the primary electrical power source to said illumination means, said power supply module being attached to a rear surface of said reflector either above or below a horizontal center line of said reflector.

12. A lighting device according to claim 11, wherein said power supply module includes rectifier means for rectifying the primary electrical power source into direct current for powering said illumination means.

13. A lighting device according to claim 11, wherein said power supply module further includes an emergency electrical power source to provide auxiliary power to said illumination means in the event of failure of the primary electrical power source.

14. A lighting device according to claim 13, wherein said emergency electrical power source includes at least one rechargeable battery, a charging device for keeping said at least one rechargeable battery fully charged during periods of non-use and transfer means for switching between said emergency electrical power source and the primary electrical power source.

15. A lighting device according to claim 1, further comprising a diffuser deflector placed in front of said illumination means between said illumination means and the indicia to be illuminated.

16. A lighting device according to claim 15, wherein said diffuser deflector is opaque.

17. A lighting device according to claim 15, wherein said diffuser deflector is transparent.

18. A lighting device according to claim 2, wherein at least one row of said light emitting diodes is parallel to said V-shaped contour.

19. A lighting device according to claim 2, wherein one row of said light emitting diodes is parallel to said V-shaped contour, and another row of said light emitting diodes is staggered to generally follow the contour of one-half of an X in the word EXIT.

20. A lighting device according to claim 19, wherein said rows of light emitting diodes are positioned a sufficient distance from said V-shaped contour to provide illumination to the sides of the EXIT sign housing parallel to said V-shaped contour.

21. A lighting device according to claim 2, wherein each of said light emitting diodes are positioned adjacent to said reflector and at a distance from the indicia to be illuminated.

22. A lighting device according to claim 2, further comprising baffle means mounted to said reflector for minimizing the area within said reflector required to be illuminated by said rows of light emitting diodes.

23. A lighting device for illuminating indicia of an EXIT sign having a sign housing defining an enclosure therein and having indicia to be illuminated and having a primary electrical power source, comprising;

a reflector having a shallow V-shaped contour defining a centrally located valley therein; said reflector including a first reflective surface on a first side of said valley and a second reflective surface on a second side of said valley;

illumination/means positioned in said valley of said reflector to be powered by the primary electrical power source, said illumination means including two rows of light emitting diodes, each row having a plurality of light emitting diodes, said rows being separated from one another and positioned on either side of said valley for illuminating said reflector V-shaped contour including said valley; and a power supply module for providing the primary electrical power source to said illumination means, said power supply module being attached to a rear surface of said reflector.

24. A lighting device according to claim 23, wherein said power supply module is attached either above or below a horizontal center line of said reflector.

25. A lighting device according to claim 23, wherein said power supply module covers the entire rear surface of said reflector.

26. A lighting device according to claim 23, wherein said power supply module includes rectifier means for rectifying the primary electrical power source into direct current for powering said illumination means.

27. A lighting device according to claim 23, wherein said power supply module further includes an emergency electrical power source to provide auxiliary power to said illumination means in the event of failure of the primary electrical power source.

* * * * *

UNITED STATES PATENT AND TRADEMARK OFFICE

CERTIFICATE OF CORRECTION

PATENT NO. : 5,539,623

DATED : July 23, 1996

INVENTOR(S) : Gurz et al.

It is certified that error appears in the above-indentified patent and that said Letters Patent is hereby corrected as shown below:

Column 6, line 23, "army" should read --array--

Claim 23, column 10, line 27, "valley therein;" should read --valley therein,--

Claim 23, column 10, line 31, "illumination/means" should read --illumination means--

Signed and Sealed this

Eighth Day of October, 1996

Bruce Lehman

*Attest:*

BRUCE LEHMAN

*Attesting Officer*

*Commissioner of Patents and Trademarks*